US006846058B2

(12) United States Patent
Claramunt et al.

(10) Patent No.: US 6,846,058 B2
(45) Date of Patent: Jan. 25, 2005

(54) MEDIA POSITIONING WITH DIFFERENTLY ACCURATE SENSORS

(75) Inventors: David Claramunt, Sant Esteve ses Rovires (ES); Carles Flotats, Barcelona (ES); Jose M Rio Doval, Sant Cugat del Valles (ES); Rodrigo Ruiz, Terrassa (ES); Fancesc Subirada, Castellbisbal (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 100 days.

(21) Appl. No.: 10/419,326

(22) Filed: Apr. 19, 2003

(65) Prior Publication Data

US 2004/0207673 A1 Oct. 21, 2004

(51) Int. Cl.[7] ..... B65H 7/00; B65H 7/02; B65H 7/14; B41J 11/42; B41J 11/44

(52) U.S. Cl. ..... 347/16; 347/218; 347/264; 400/582

(58) Field of Search ..... 347/16, 101, 104, 347/153, 218, 264, 19; 400/582, 583, 583.2, 583.3, 583.4

(56) References Cited

U.S. PATENT DOCUMENTS

| | | | | | |
|---|---|---|---|---|---|
| 5,940,105 | A | * | 8/1999 | Hayami | 347/104 |
| 6,118,832 | A | | 9/2000 | Mayrargue et al. | |
| 6,412,907 | B1 | * | 7/2002 | Castelli et al. | 347/37 |
| 2002/0037191 | A1 | * | 3/2002 | Lesniak et al. | 400/582 |
| 2002/0097291 | A1 | * | 7/2002 | Castelli et al. | 347/19 |

* cited by examiner

*Primary Examiner*—Huan Tran

(57) ABSTRACT

An embodiment of the invention is disclosed in which media advances at a first speed to an interim position based on signals from a first sensor having a first accuracy. While the media is advancing at the first speed, signals are accumulated from a second sensor having a second accuracy greater than the first accuracy. Upon the media reaching the interim position, an actual position of the media is adjusted based on the signals accumulated from the second sensor.

26 Claims, 6 Drawing Sheets

MEDIA POSITIONING WITH DIFFERENTLY ACCURATE SENSORS

BACKGROUND

Image-forming devices are frequently used to form images on media, such as paper and other types of media. Image-forming devices include laser printers, inkjet printers, and other types of printers and other types of image-forming devices. Media is commonly moved through an image-forming device as the device forms the image on the media. The image-forming mechanism of the device, such as an inkjet-printing mechanism, may move in a direction perpendicular to that in which the media moves through the image-forming device. Alternatively, the image-forming mechanism may remain in place while the media moves past it.

For high-quality image formation, the movement of the media through an image-forming device is desirably precisely controlled. If the media moves more than intended, there may be gaps in the resulting image formed on the media, whereas if the media moves less than intended, there may be areas of overlap in the resulting image. In certain environments, such as commercial and industrial environments, both high-quality image formation and fast throughput are desired. However, advancing media through an image-forming device quickly can be antithetical to precise control of such media advancement. Precisely controlled, and fast, media advancement can thus be difficult to achieve.

SUMMARY OF THE INVENTION

An embodiment of the invention advances media at a first speed to an interim position based on signals from a first sensor having a first accuracy. While the media is advancing at the first speed, signals are accumulated from a second sensor having a second accuracy greater than the first accuracy. Upon the media reaching the interim position, an actual position of the media is adjusted based on the signals accumulated from the second sensor.

BRIEF DESCRIPTION OF THE DRAWINGS

The drawings referenced herein form a part of the specification. Features shown in the drawing are meant as illustrative of only some embodiments of the invention, and not of all embodiments of the invention, unless explicitly indicated, and implications to the contrary are otherwise not to be made.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Controlling Media Advancement Using Sensors Having Different Accuracies

Figure 1:
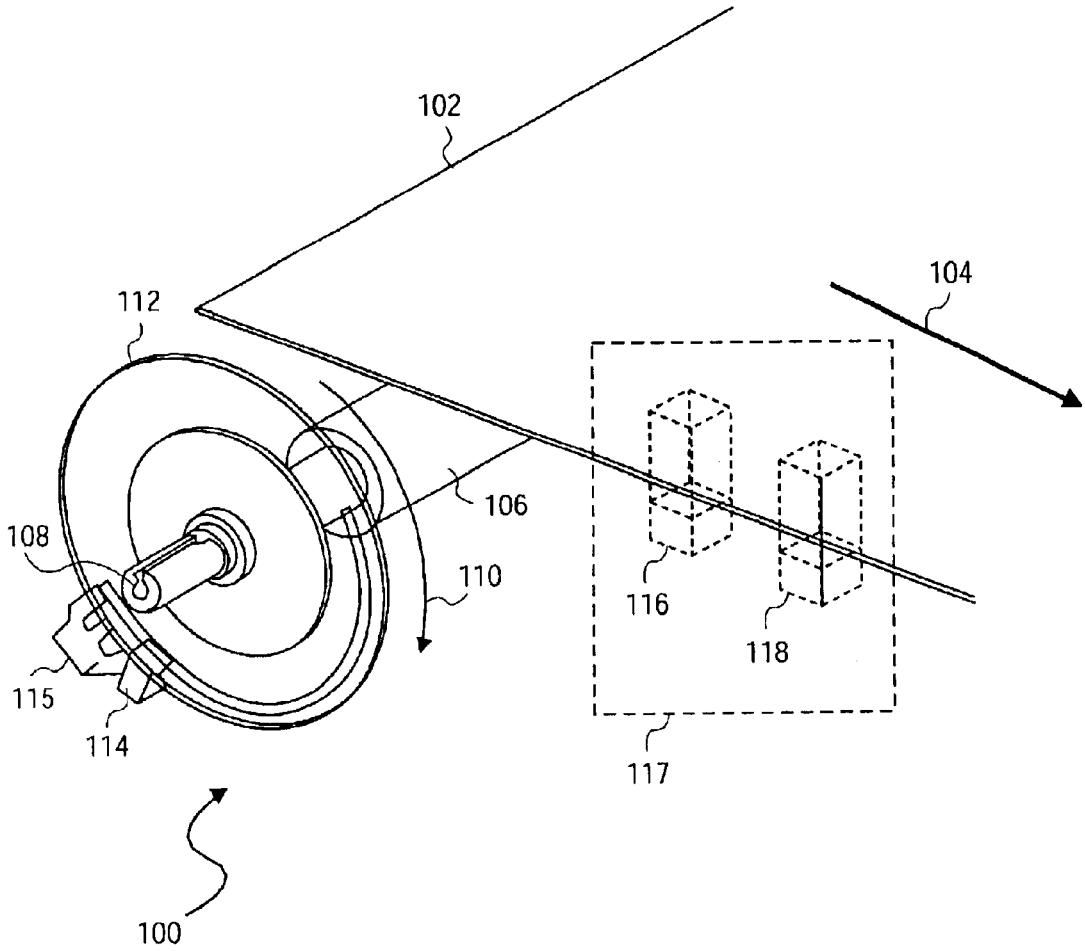
FIG. 1 is a diagram of a media-advance mechanism of an image-forming mechanism, according to an embodiment of the invention.

FIG. 1 shows a media-advance mechanism 100, according to an embodiment of the invention. The media-advance mechanism 100 can be utilized within an image-forming device, such as an inkjet printer, or another type of image-forming device. The media-advance mechanism 100 advances the media 102 in the direction of the arrow 104. This is accomplished by a roller 106 rotating in the direction of the arrow 110. Friction between the media 102 and the roller 106 causes the media 102 to advance. The roller 106 is itself situated on a roller shaft 108. The roller shaft 108 is rotated via a motor, which is not shown in FIG. 1.

To control the advancement of the media 102, there are two sensors: an optical sensor 114, and an image-recognition sensor 117. An encoder disc 112 is situated on the roller shaft 108, and rotates as the roller shaft 108 rotates. The encoder disc 112 has a pattern of lines printed thereon at a given pitch, such as 200 lines per inch, that the optical sensor 114 reads, or senses, as the encoder disc 112 rotates through the optical sensor 114. The sensor 114 in response outputs a pulsed signal, such as a digital or analog signal, based on the lines read. A mechanism 115 associated with the optical sensor 114 converts the incremental encoding provided by the sensor 114 into an absolute encoding, and thus an absolute measure of the angle of the roller shaft 108.

The sensor 114 is more generally a high-resolution, low-accuracy sensor. It is a high-resolution sensor in that the sensor 114 is able to constantly provide signals regarding the positioning of the media 102. As the roller shaft 108 rotates, the encoder disc 112 also rotates, and the sensor 114 is able to constantly provide signals. The sensor 114 is a low-accuracy sensor in that the signals that it provides do not necessarily reflect the actual positioning of the media 102. This is because the sensor 114 reflects movement, or rotation, of the roller shaft 108, which is an indirect indication of movement, or advancement, of the media 102. If the media 102 slips on the roller 106, for instance, the signals provided by the sensor 114 will not accurately reflect the advancement of the media 102.

By comparison, the image-recognition sensor 117 includes two area-of-vision detectors 116 and 118 that directly monitor the displacement of the media 102. Each of the detectors 116 and 118 is able to sense an image of the media 102 as the media 102 passes thereover. The detector 116 first senses an image of the media 102. When the detector 118 has detected the same image, the length of time that has passed is employed to determine how far the media 102 has advanced. Thus, the images are utilized to determine how far the media 102 has advanced.

The image-recognition sensor 117 is more generally a low-resolution, high-accuracy sensor. The image-recognition sensor 117 is a high-accuracy sensor because it directly reflects movement, or advancement, of the media 102. That is, the image-recognition sensor 117 directly senses the media 102, as opposed to indirectly indicating positioning of the media 102. The image-recognition sensor 117 is a low-resolution sensor because it provides signals only periodically at discrete moments in time, when the image captured by the detector 116 subsequently is captured by the detector 118. During other times, the image-recognition sensor 117 is not able to provide signals regarding the positioning of the media 102.

Thus, advancement of the media 102 by the media-advance mechanism 100 can be monitored and controlled by using the sensors 114 and 117. The sensor 114 provides constant, low-accuracy signals, whereas the sensor 117 provides periodic, high-accuracy signals. The accuracy of the sensor 114 in the signals it can provide regarding the positioning of the media 102 is therefore lower than the accuracy of the sensor 117 in the signals the sensor 117 can provide regarding the positioning of the media 102. However, the resolution of the sensor 114 in terms of the frequency of the signals it can provide is greater than the resolution of the sensor 117.

That is, the resolution of a sensor, such as the sensor 114 or the sensor 117, is related to the frequency at which the sensor captures images, and the speed at which media, such as the media 102, moves relative to the sensor. A high-resolution sensor, for instance, captures images of media with greater frequency as the media moves relative to the sensor than does a low-resolution sensor. Thus, a sensor that may capture 100 images of the media as the media has moved one inch past the sensor has a higher resolution than does a sensor that may capture 10 images of the media as the media has moved one inch past the sensor. This means that the former sensor captures images more frequently than the latter sensor does, such that the higher-resolution sensor captures images at a greater frequency than does the lower-resolution sensor. In other words, a lower-resolution sensor captures images less often than does a higher-resolution sensor.

Figure 2:
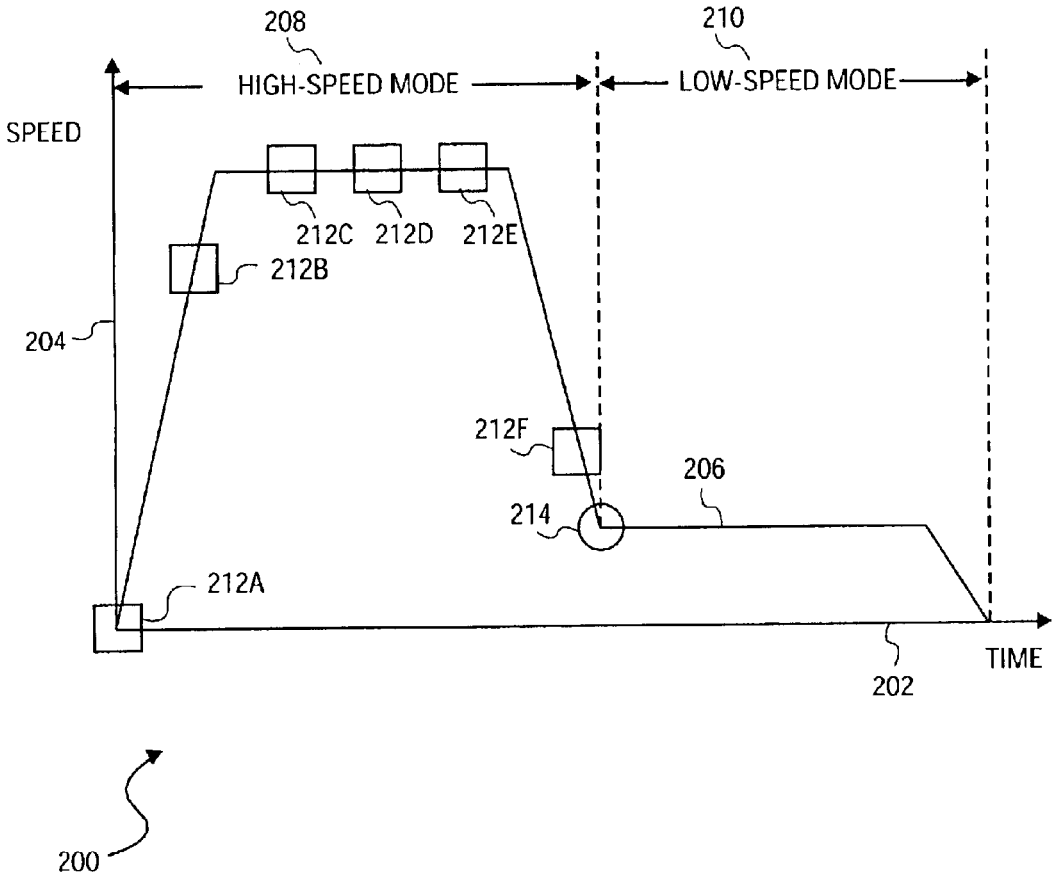
FIG. 2 is a graph of a speed-time profile for media advancement, according to an embodiment of the invention.

FIG. 2 shows a graph 200 of a speed-time profile 206 for advancing the media 102 by the media-advance mechanism 100 utilizing the sensors 114 and 117, according to an embodiment of the invention. The x-axis 202 of the graph indicates time, against which the y-axis 204 indicates speed of media advancement. The media-advance mechanism 100 advances the media 102 in two modes, a high-speed mode 208, and a low-speed mode 210. The media 102 is advanced in the high-speed mode 208 at a greater speed than when it is advanced in the low-speed mode 210. The media 102 travels to an interim position close to a desired final position in the high-speed mode 208, and then travels to the final position from the interim position in the low-speed mode 210.

While the media 102 advances in the high-speed mode 208, the low-accuracy but high-resolution sensor 114 is primarily used to track the position of the media 102. That is, the media 102 is primarily advanced to the interim position based on constant signals received from the high-resolution sensor 114. However, the high-accuracy but low-resolution sensor 117 will provide periodic signals, which are accumulated. These signals are accumulated from the sensor 117 at the times indicated by the boxes 212A, 212B, 212C, 212D, 212E, and 212F, collectively referred to as the boxes 212. At the time indicated by the circle 214, the media 102 has advanced to the interim position, and advancement is no longer conducted in the high-speed mode 208.

At the interim position, the actual position of the media 102 is determined as substantially as possible by utilizing the accumulated signals from the sensor 117. While moving in the high-speed mode 208, the media 102 may have slipped, for instance, on the roller 106, which the signals from the sensor 114 do not reflect, but which the signals from the sensor 117 do reflect. Therefore, the actual position of the media 102 at the time indicated by the circle 214 is determined based on the accumulated signals from the sensor 117, before the media 102 begins to advance again, in the low-speed mode 210. It is noted that the profile 206 in the high-speed mode 208 is trapezoid shaped, whereas the profile 206 in the low-speed mode 210 is substantially trapezoid shaped.

In the low-speed mode 210, the media 102 is advanced from its interim position, as may have been adjusted based on the accumulated signals from the sensor 117, to a desired final position at the end of the profile 206. In the low-speed mode 210, advancement of the media 102 is determined by the high-resolution but low-accuracy sensor 114. Because the media 102 advances much more slowly in the low-speed mode 210 than in the high-speed mode 208, the potential for media slippage is greatly reduced, and thus the accuracy of the sensor 114 is sufficient to control movement of the media 102 from the interim to the final position in the low-speed mode 210.

Method for Controlling Media Advancement

Figure 3:
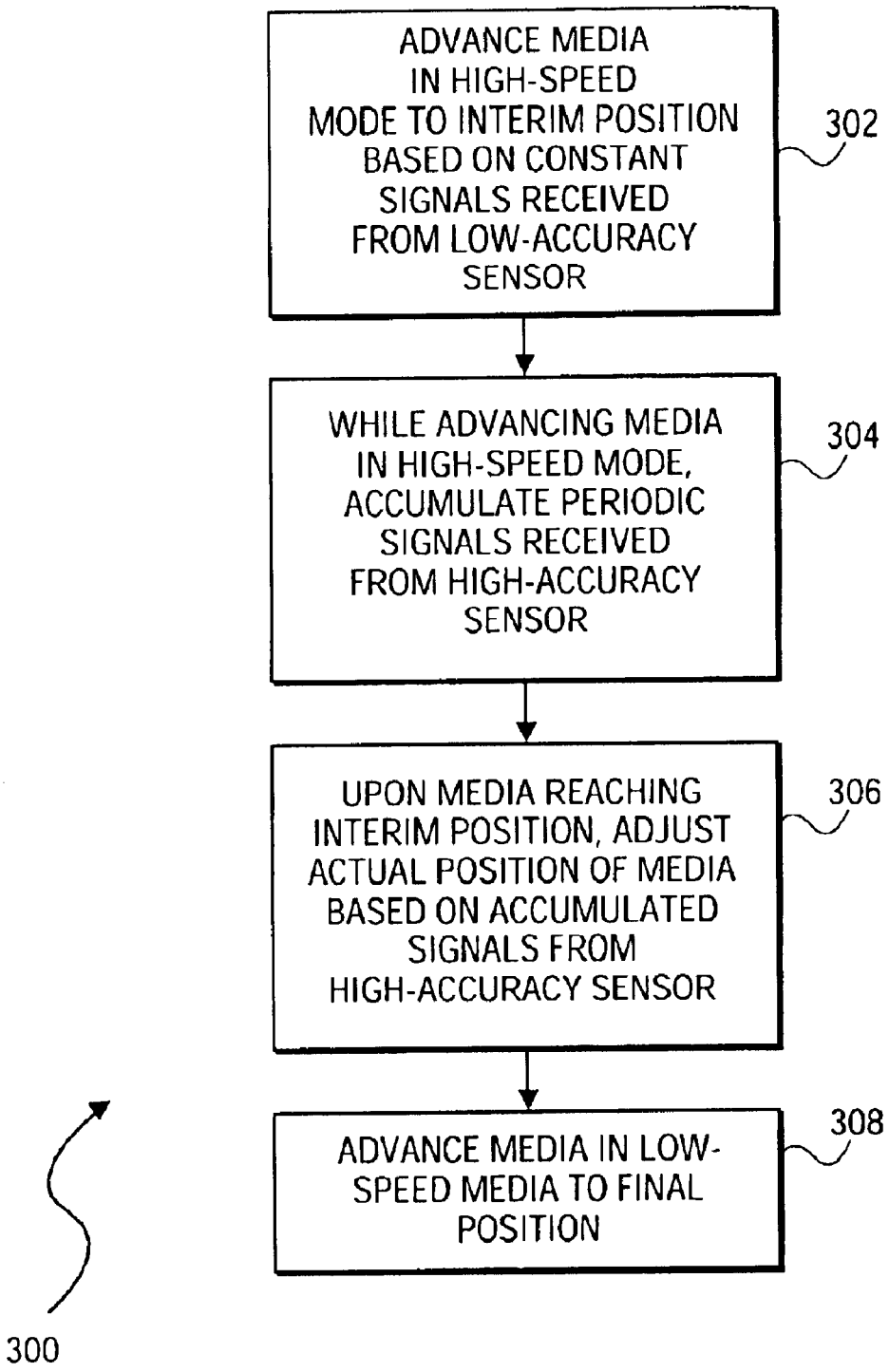
FIG. 3 is a method for controlling media advancement, according to an embodiment of the invention.

FIG. 3 shows a method 300 for controlling media advancement using both a high-accuracy, low-resolution sensor and a low-accuracy, high-resolution sensor, according to an embodiment of the invention. The method 300 may be implemented as a computer program stored on a computer-readable medium. For instance, the computer-readable medium may be the firmware of an image-forming device like an inkjet printer. One example of a high-accuracy, low-resolution sensor that can be utilized in the method 300 is the sensor 117 of FIG. 1, whereas one example of a low-accuracy, high-resolution sensor that can be utilized in the method 300 is the sensor 114 of FIG. 1.

The media is first advanced in a high-speed mode to an interim position, based on constant signals received from the low-accuracy, but high-resolution, sensor (302). While the media is advancing in the high-speed mode, periodic signals received from the high-accuracy, but low-resolution, sensor are accumulated, (304). These periodic signals are accumulated without slowing advancement of the media. Once the media reaches the interim position, the actual position of the media is adjusted based on the accumulated signals received from the high-accuracy sensor (306).

The periodic signals from the high-accuracy sensor more accurately denote the actual position of the media than the constant signals from the low-accuracy sensor. The position of the media is not adjusted when these periodic signals are received, but once the advancement of the media has exited the high-speed mode. Finally, the media is advanced in a low-speed mode to a desired final position (308). The media may be advanced in the low-speed mode based on the constant signals received from the low-accuracy sensor. The speed at which the media travels in the low-speed mode is less than the speed at which the media traveled in the high-speed mode.

Figure 4:
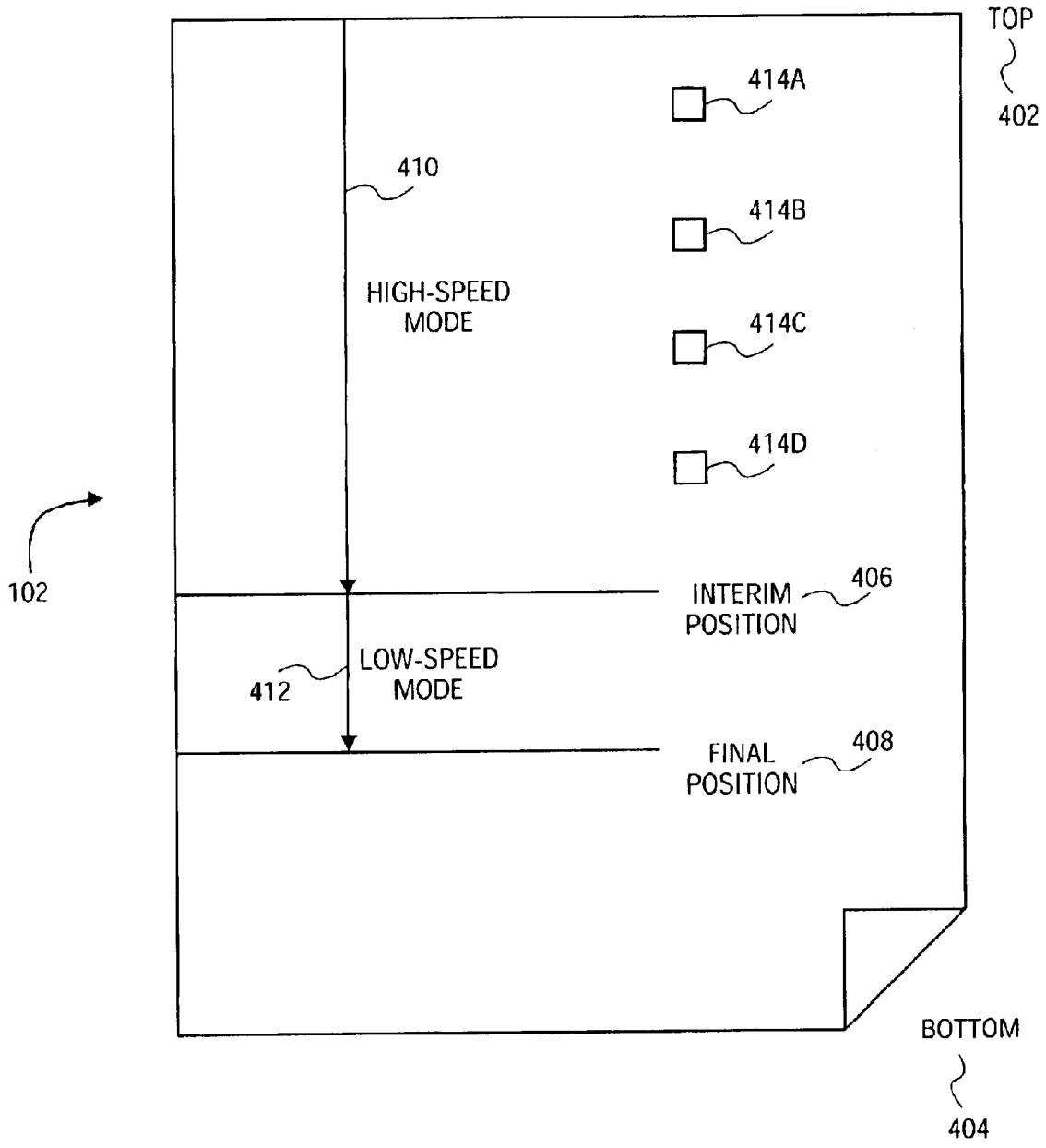
FIG. 4 is a diagram of media relative to which the method of FIG. 3 is illustratively performed as an example, according to an embodiment of the invention.

FIG. 4 shows an illustrative example of the method 300 being performed relative to the media 102, according to an embodiment of the invention. The media 102 is advanced through a media-advance mechanism, such as the media-advance mechanism 100 of FIG. 1, from the top 402 of the media 102 through the bottom 404 of the media 102. In the high-speed mode, the media 102 is advanced from the top 402 to an interim position 406, as indicated by the line 410, based on constant signals received from the high-resolution, low-accuracy sensor. The low-resolution, high-accuracy sensor provides periodic signals when the media has traveled to the positions indicated by the boxes 414A, 414B, 414C, and 414D, collectively referred to as the boxes 414.

Once the media 102 has reached the interim position 406, the periodic signals from the high-accuracy sensor that have been accumulated are employed to more accurately denote the actual position of the media 102. That is, the actual position of the media 102 as denoted by the periodic signals from the high-accuracy sensor may vary from the interim position 406 of the media 102 as denoted by the constant signals from the low-accuracy sensor. Therefore, the interim position 406 of the media 102 is adjusted based on the periodic signals received from the high-accuracy sensor. Finally, in the low-speed mode, the media 102 is advanced from the interim position 406 of the media 102, as has been adjusted, to the final position 408, as indicated by the arrow 412.

Image-Forming Device

Figure 5:
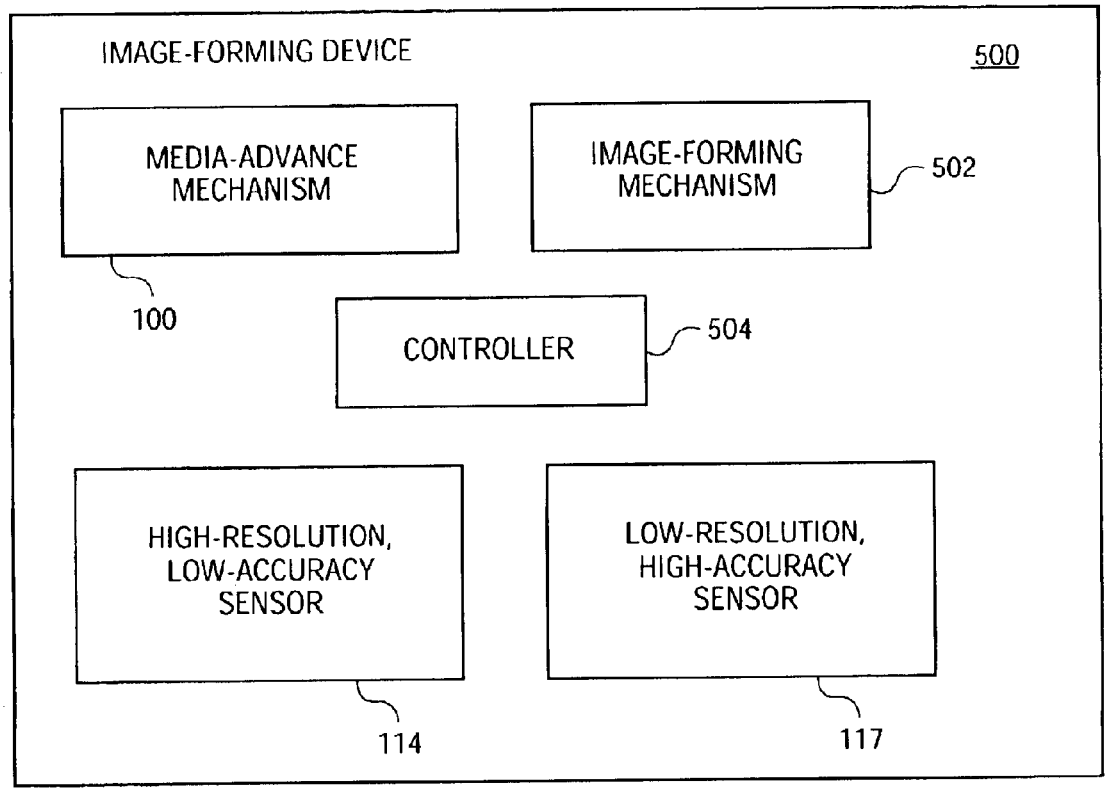
FIG. 5 is a block diagram of an image-forming device, according to an embodiment of the invention.

FIG. 5 shows a block diagram of an image-forming device 500, according to an embodiment of the invention. The image-forming device 500 includes the media-advance mechanism 100, an image-forming mechanism 502, a controller 504, and the sensors 114 and 117. The sensor 114 is more generally a high-resolution, low-accuracy sensor, whereas the sensor 117 is more generally a low-resolution, high-accuracy sensor, as has been described. As can be appreciated by those of ordinary skill within the art, the image-forming device 500 depicted in FIG. 5 is generalized, and may and typically does include components in addition to and/or in lieu of those denoted in FIG. 5.

The media-advance mechanism 100 advances media through the image-forming device 500, whereas the image-forming mechanism 502 forms an image on the media as the media is advanced by the media-advance mechanism 100. The image-forming mechanism 502 may be an inkjet-printing mechanism, another type of fluid-ejecting mechanism, a laser-printing mechanism, or another type of image-forming mechanism. Where the image-forming mechanism 502 is an inkjet-printing mechanism, the image-forming device 500 may be considered an inkjet printer, whereas where the image-forming mechanism 502 is a laser-printing mechanism, the image-forming device 500 may be considered a laser printer, and so on.

The controller 504 is hardware, software, or a combination of hardware or software, and can be the firmware of the image-forming device 500. The controller 504 at least controls the media-advance mechanism 100 to advance the media in accordance with a speed-time profile as has been described, such as the speed-time profile 206 of FIG. 2, which has a trapezoidal first part corresponding to a high-speed mode and a partially trapezoidal second part corresponding to a low-speed mode. The controller 504 may be that which performs the method 300 of FIG. 3. Thus, the controller 504 controls the media-advance mechanism 100 based on constant signals received from the sensor 114 and periodic signals received from the sensor 117, as has been described.

Alternative Embodiments and Conclusion

It is noted that, although specific embodiments have been illustrated and described herein, it will be appreciated by those of ordinary skill in the art that any arrangement that is calculated to achieve the same purpose may be substituted for the specific embodiments shown. Other applications and uses of embodiments of the invention, besides those described herein, are amenable to at least some embodiments. This application is intended to cover any adaptations or variations of the present invention. Therefore, it is manifestly intended that this invention be limited only by the claims and equivalents thereof.

Figure 6:
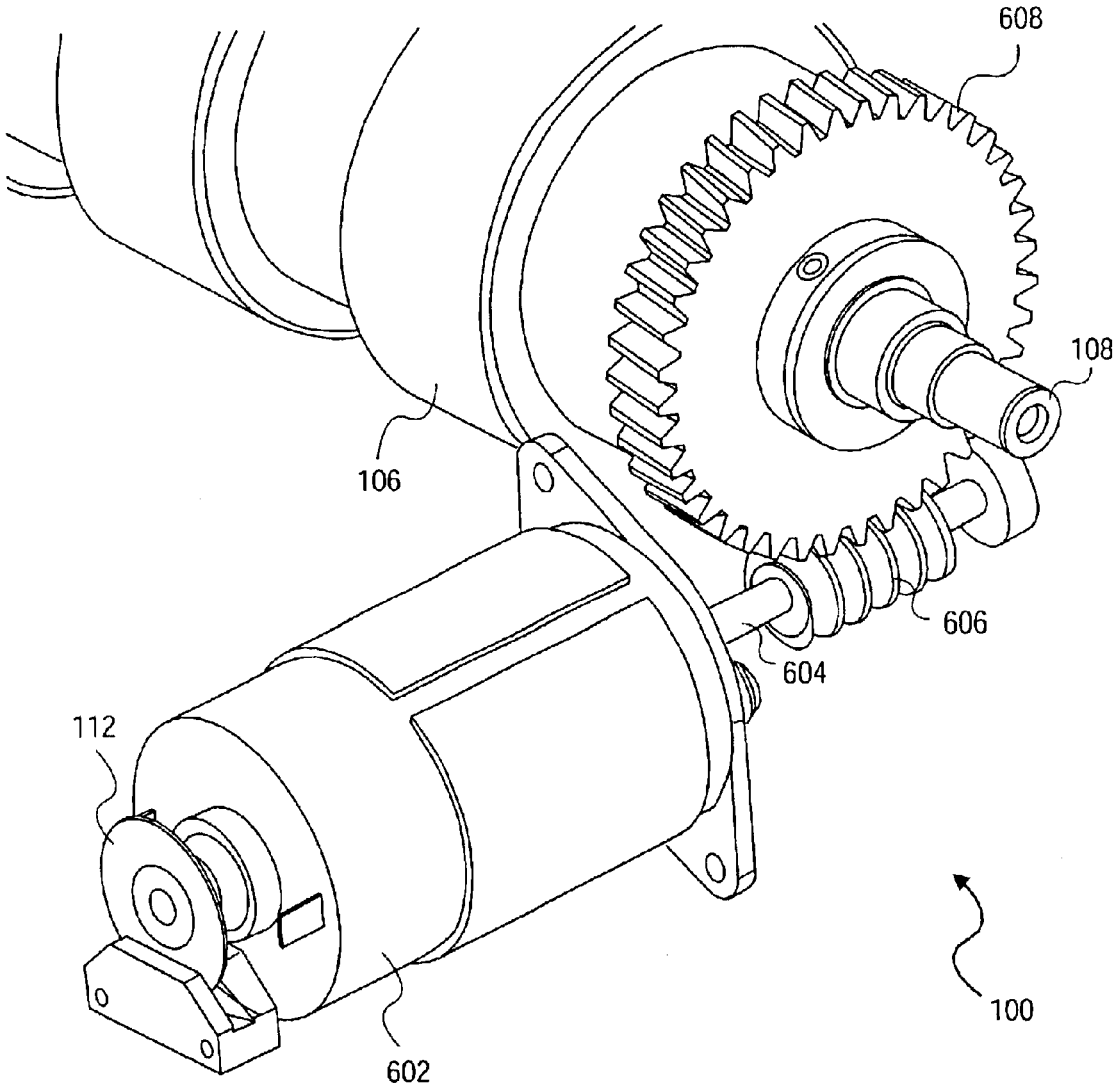
FIG. 6 is a diagram of a media-advance mechanism of an image-forming mechanism, according to an alternative embodiment of the invention.

For example, FIG. 6 shows the media-advance mechanism 100, according to an alternative embodiment of the invention. The media-advance mechanism 100 of the embodiment of FIG. 6 has the encoder disc 112 situated on a motor 602, as opposed to situated on the roller shaft 108. The motor 602 rotates the motor shaft 604, which rotates the motor gearing 606. The motor gearing 606 interacts with the roller gearing 608, rotating the roller shaft 108, and thus the roller 106.

We claim:

1. A method comprising:

advancing media at a first speed to an interim position based on signals from a first sensor having a first accuracy;

while advancing the media at the first speed, accumulating signals from a second sensor having a second accuracy greater than the first accuracy; and, upon the media reaching the interim position, adjusting an actual position of the media based on the signals accumulated from the second sensor.

2. The method of claim 1, further comprising advancing the media at a second speed less than the first speed from the actual position to a final position.

3. The method of claim 2, wherein advancing the media at the second speed from the actual position to the final position comprises advancing the media at the second speed to the final position based on further signals from the first sensor.

4. The method of claim 1, wherein accumulating the signals from the second sensor comprises receiving signals at a lower resolution from the second sensor as compared to a resolution at which the signals from the first sensor are received.

5. The method of claim 1, wherein accumulating the signals from the second sensor comprises accumulating the signals from the second sensor such that the signals are received from the second sensor less often than the signals from the first sensor are received.

6. The method of claim 1, wherein accumulating the signals from the second sensor comprises accumulating the signals from the second sensor at a lower frequency than a frequency at which the signals from the first sensor are received.

7. The method of claim 1, wherein accumulating the signals from the second sensor comprises accumulating the signals from the second sensor without slowing advance of the media at the first speed.

8. The method of claim 1, wherein adjusting the actual position of the media comprises adjusting the actual position of the media as varying from the interim position based on the signals from the second sensor more accurately denoting the actual position of the media than the signals from the first sensor.

9. An image-forming device comprising:

a media-advance mechanism to advance media through the image-forming device;

a first sensor providing signals to provide signals indicating positioning of the media at a first accuracy and at a first resolution;

a second sensor providing signals to provide signals indicating the positioning of the media at a second accuracy greater than the first accuracy and at a second resolution less than the first resolution; and, a controller to control the media-advance mechanism to advance the media in accordance with a speed-time profile having a trapezoidal first part and a partially trapezoidal second part based on the signals received from the first sensor and the second sensor.

10. The image-forming device of claim 9, wherein the media-advance mechanism comprises a motor relative to which the first sensor is situated.

11. The image-forming device of claim 9, wherein the media-advance mechanism comprises a roller shaft relative to which the second sensor is situated.

12. The image-forming device of claim 9, wherein the first sensor is an optical sensor.

13. The image-forming device of claim 9, wherein the second sensor is an image-recognition sensor.

14. The image-forming device of claim 9, wherein the controller controls the media-advance mechanism to advance the media in accordance with the trapezoidal first part of the speed-time profile based on constant signals from the first sensor.

15. The image-forming device of claim 9, wherein the controller controls the media-advance mechanism to adjust the positioning of the media between the trapezoidal first part of the speed-time profile and the partially trapezoidal second part of the speed-time profile based on accumulated signals from the second sensor during control of the media-advance mechanism to advance the media in accordance with the trapezoidal first part of the speed-time profile.

16. The image-forming device of claim 9, wherein the controller controls the media-advance mechanism to adjust the positioning of the media between the trapezoidal first part of the speed-time profile and the partially trapezoidal second part of the speed-time profile based on accumulated signals from the second sensor more accurately denoting the positioning of the media than constant signals from the first sensor, on which basis the controller controls the media-advance mechanism to advance the media in accordance with the trapezoidal first part of the speed-time profile.

17. The image-forming device of claim 9, wherein the controller controls the media-advance mechanism to advance the media in accordance with the partially trapezoidal second part of the speed-time profile based on constant signals from the first sensor.

18. The image-forming device of claim 9, wherein the image-forming device is an inkjet printer.

19. An image-forming device comprising:

a high-resolution, low-accuracy first sensor to provide signals indicating positioning of media;

a low-resolution, high-accuracy second sensor to provide signals indicating the positioning of the media; and, means for accumulating the signals from the second sensor while the media advances at high speed based on the signals from the first sensor and for adjusting the positioning of the media based on the accumulated signals from the second sensor after the media has advanced at the high speed.

20. The image-forming device of claim 19, wherein the first sensor is an optical sensor and the second sensor is an image-recognition sensor.

21. The image-forming device of claim 19, wherein the means is further for advancing the media at the high speed based on the signals from the first sensor.

22. The image-forming device of claim 19, wherein the means is further for advancing the media at low speed based on the signals from the first sensor after adjusting the positioning of the media based on the accumulated signals from the second sensor.

23. The image-forming device of claim 19, wherein the image-forming device is an inkjet printer.

24. A computer-readable medium having a computer program stored thereon to perform a method comprising:

advancing media in a high-speed mode to an interim position based on constant signals from a first sensor having a first accuracy;

while advancing the media in the high-speed mode, accumulating periodic signals from a second sensor having a second accuracy greater than the first accuracy;

upon the media reaching the interim position, adjusting an actual position of the media based on the periodic signals accumulated from the second sensor; and, advancing the media in a low-speed mode from the actual position to a final position.

25. The computer-readable medium of claim 24, wherein accumulating the periodic signals from the second sensor comprises accumulating the periodic signals from the second sensor without slowing advance of the media in the high-speed mode.

26. The computer-readable medium of claim 24, wherein adjusting the actual position comprises adjusting the actual position of the media as varying from the interim position based on the periodic signals from the second sensor more accurately denoting the actual position of the media than the constant signals from the first sensor.

* * * * *